United States Patent [19]

Aoshika

[11] Patent Number: 4,999,748

[45] Date of Patent: Mar. 12, 1991

[54] SYSTEM FOR SECURING ILLUMINATION INSTRUMENT

[76] Inventor: Takayuki Aoshika, 15-3, Asakusa 3-chome, Taito-ku, Tokyo, Japan

[21] Appl. No.: 413,624

[22] Filed: Sep. 28, 1989

[30] Foreign Application Priority Data

Sep. 30, 1988 [JP] Japan ..... 63-243894

[51] Int. Cl.[5] ..... F21S 1/02

[52] U.S. Cl. ..... 362/147; 362/277; 362/285; 362/368; 362/372; 362/406

[58] Field of Search ..... 362/145, 147, 148, 277, 362/285, 364, 365, 368, 372, 404, 406

[56] References Cited

U.S. PATENT DOCUMENTS 2,762,598 9/1956 Runge ..... 362/404
3,512,743 5/1970 Lipscomb ..... 362/404
4,327,402 4/1982 Aubrey ..... 362/285
4,595,969 6/1986 McNair ..... 362/285

*Primary Examiner*—Allen M. Ostrager
*Assistant Examiner*—Sue Hagerman
*Attorney, Agent, or Firm*—Malcolm B. Wittenberg

[57] ABSTRACT

A system for fixedly securing an illumination instrument to a ceiling of a building structure, comprises a flexible suspender adapted to be connected to an under surface of a slab of the building structure and extending generally vertically therefrom, a suspender grasping assembly for releasably grasping the flexible suspender to move therealong in a vertical direction and to be held at any desired height, and engaging member frictionally engaging with an outer periphery of the suspender grasping assembly to hold an illumination instrument support member at a temporal set position.

8 Claims, 4 Drawing Sheets

SYSTEM FOR SECURING ILLUMINATION INSTRUMENT

BACKGROUND OF THE INVENTION

1. Field of the Invention;

The present invention relates to a system for securing an illumination or lighting instrument to the ceiling of a room by suspending the same from a slab of a building structure.

2. Prior Art Statement:

In order to fixedly securing illumination instruments in a building used for office rooms and other purposes, there has hitherfore been used a system wherein illumination instruments are suspended from slabs of the building while using bolts and nuts for fixing the illumination instruments at desired height. In this known system, a straight bolt is cut to have a length measured to extend from the surface of a ceiling finish board to the slab, applied with rustproof treatment and then secured to the slab. A guide assembly having a chain for raising the illumination instrument is then attached to the bolt, followed by adjustment of the height, and then an illumination support plate or housing is raised by the chain. After detaching the guide assembly, a nut and a washer are fitted on the bolt and then the nut is threaded so that it moves upwards to fix the illumination instrument.

However, this known system has disadvantages that cumbersome and dangerous operation is necessary for fixing the illumintion instrument resulting in reduction in operation efficiency, since the relatively heavy illumination instrument must be supported by least two workers' hands who are staying on high stepladders and the illumination instrument must be raised and lowered by them to adjust the height of the illumination instrument so that it is snugly fitted to cover an opening of the ceiling finish board. The known system has a further problem that an additional anchor must be driven into the slab at a different position when the existing anchor for suspending the bolt from the slab is not exactly coplanar with the opening of the ceiling finish board.

OBJECTS AND SUMMARY OF THE INVENTION:

An object of this invention is to overcome the disadvantages of the conventional technology and to provide a system for fixedly securing an illumination instrument safely and rapidly, in which a flexible suspender member, such as a metal wire or cable, is used in place of the straight bolt used in the conventional system.

In order to achieve the aforementioned object, the present invention provides a system for fixedly securing an illumination instrument to a ceiling of a building structure, comprising a flexible suspender adapted to be connected to the under surface of a slab of the building structure and extending generally vertically therefrom, a suspender grasping assembly for releaseably grasping the flexible suspender to move therealong in a vertical direction and to be held at any desired height, and engaging means frictionally engaging with an outer periphery of the suspender grasping assembly to hold an illumination instrument support member at a temporal set position.

DESCRIPTION OF PREFERRED EMBODIMENTS

Figure 1A:
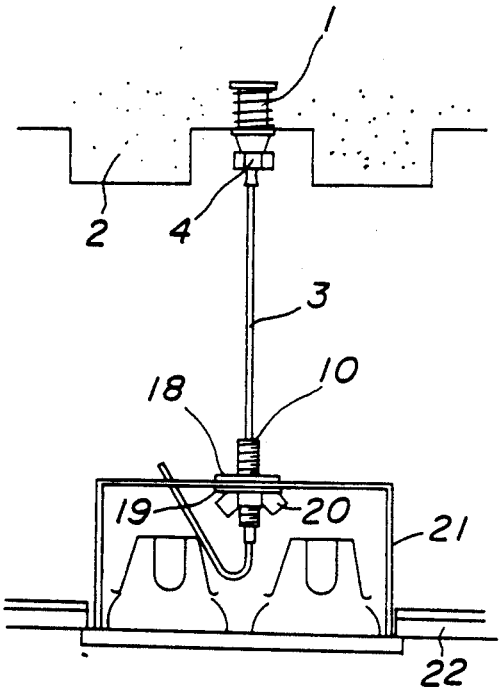
Figs. 1*a*, 1*b* and 1*c* are partially sectional views schematically showing presently preferred embodiments of this invention.
Figure 1B:
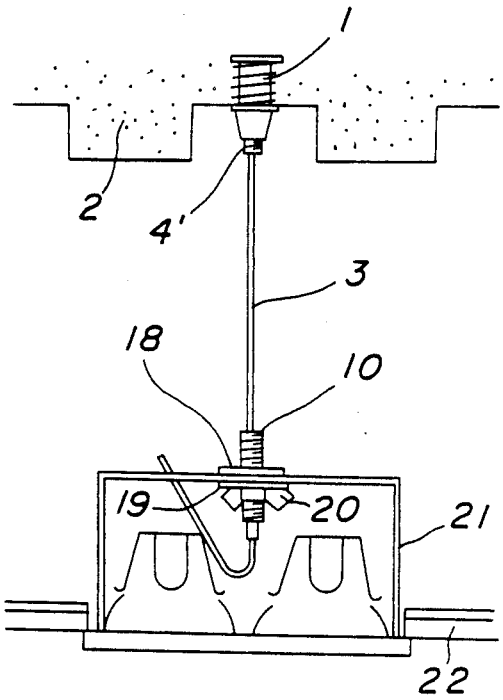
Figure 1C:
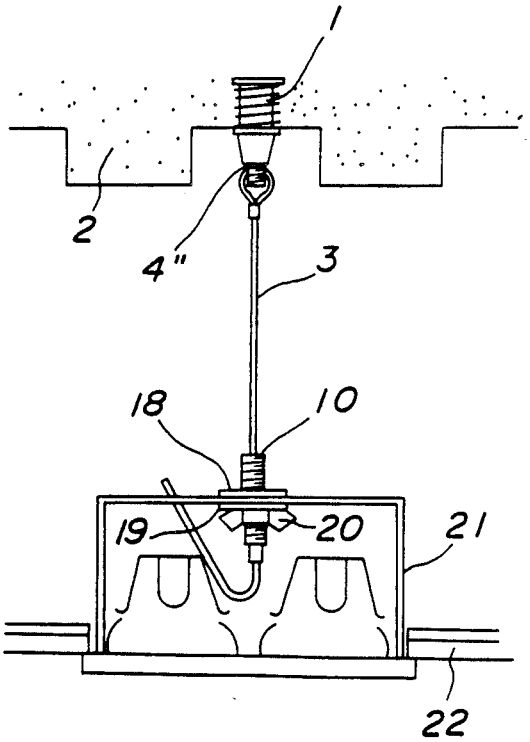

Referring to the appended drawings, presently preferred embodiments of this invention will now be described in detail. FIGS. 1*a*, 1*b* and 1*c* are views each showing an embodiment of the system for securing an illumination instrument according to this invention.

Initially referring to FIG. 1*a*, an insert or anchor 1 is driven into a slab 2 of a building structure, and an anchor grip 4 is screw fitted to the anchor 1. One end of a wire 3 serving as a flexible suspender is firmly held by the anchor grip 4 so that it is not pulled out. In place of the anchor grip 4, the anchor 1 may be attached with a bolt 4' having a hollow cylinder in which the wire 3 is caulked, as shown in Fig. 1*b*. Alternatively, as shown in Fig. 1*c*, a bolt 4'' having a lower end formed with a transverse through-hole is threaded into the anchor 1 and one end of the wire 3 is passed through the through-hole and then looped to connect the same to the bolt 4''. Otherwise, the wire 3 may be suspended directly from the under surface of the slab 2.

Figure 2:
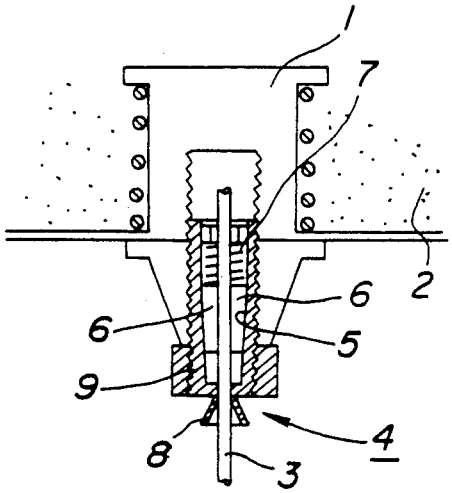
FIG. 2 is a sectional view showing the detailed construction of an anchor grip used in the embodiments of FIGS. 1*a* to 1*c*.

As shown in detail in FIG. 2, the anchor grip 4 has a tapered bore 5 converging along the downward direction as viewd in FIG. 2, and plural clamping members 6 each having therein an arcuate recess are snugly contained in the bore 5 of the anchor grip 4. The clamping members 6 are urged downwardly by means of a compression spring 7. The lower end of the bore 5 is communicated with an expanded wire guide port 8, and a clamp-releasing member 9 is disposed on the lower portion of the anchor grip 4. The end of the wire 3 once inserted from the wire guide port 8 through the arcuate recesses of the split clamping members 6 into the bore 5 cannot be drawn off, since the plural clamping members 6 are biased downwardly under the action of the spring 7 so that each of the arcuate segments defined by the inner peripheries of the split clamping members 6 is squeezed to apply a frictional force on the outer periphery of the wire 3. On the contrary, when it is desired to insert one end of the wire 3 into the anchor grip 4, it suffices only to insert the end of the wire 3 upwards through the guide port 8, whereupon the clamping members 7 move upwards against the compression force of the spring 7 to enlarge the clamping members 6 to ensure easy insertion of the wire 3.

Figure 3A:
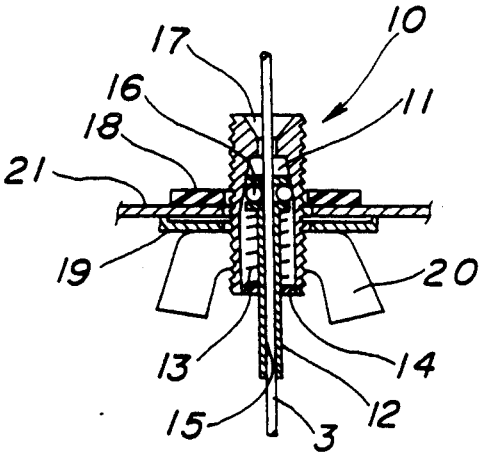
FIGS. 3*a* and 3*b* are views similar to FIG. 2, showing the detailed constructions of suspender grasping assemblies according to this invention.

Referring now to FIG. 3*a*, the suspender grasping assembly 10 receives the other end of the wire 3 and has an upwardly-converging tapered bore 11 within which a slider 12 is contained to move along the vertical direction and normally biased upwards by a compression spring 13. The lower open end of the bore 11 is closed by a plug 14, the upper surface of which constitutes a lower seat for the spring 13. The slider 12 has a leg portion through which a hollow extention 15 extending in the longituginal direction of the slider (in the illustrated embodiment, in the vertical direction) is formed, and branches defining ball-containing bores extend from the upper end of the main body (or gripper member) of the slider 12 in the direction perpendicular to the longitudinal direction of the slider 12 to contain balls 16. In the illustrated embodiment, three balls 16 are contained. At the upper end of the grasping assembly 10 provided is an upper guide port 17 which is communicated with the bore 11. The lower end of the wire 3 suspended from the slab 2 is inserted through the upper guide port 17 into the bore 11, and passed through the hollow extention 15 of the slider 12 to extend below the slider 12. Upon insertion of the wire 3 into the slider 12, the end of the wire 3 pushes the balls 16 downwards against the biasing force of the spring 13 so that the balls 16 are forced to move in the radially outward direction as the upper branched end of the slider 12 moves downwards along the tapered bore 11 to allow the wire 3 to pass through the hollow extention 15. When the wire 3 comes to a desired position or height and the downward pushing force is released, the spring 13 pushes the slider 12 upwards and the balls 16 are moved inwardly to be in clamping engagement with the outer periphery of the wire 3, whereby the wire 3 is fixed at that position to the suspender grasping assembly 10.

Figure 4A:
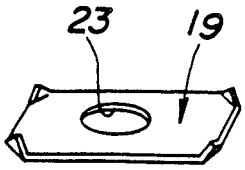
FIG. 4*a* is a perspective view showing a pawled washer used in the embodiment of FIG. 3*a*.

Around the suspender grasping assembly 10, fitted are a rubber washer 18 serving as an engaging member, and a metal washer 19 formed with pawls as best seen from FIG. 4. The metal washer 19 serves as the means for preventing rotation of an illumination instrument support member 21, and a butterfly nut 20 is threaded over the outer periphery of the main body of the suspender grsping assembly 11. The pawled wahser 19 supported by the butterfly nut 20, in turn, supports the illumination instrument support member 21 having a center hole through which the grasping assembly 10 extends. The illumination instrument support member 21 has an opening which has a shape and dimensions substantially coincident with those of the opening provided through a ceiling finish board 22. As shown in FIG. 4*a*, the pawled washer 19 preferably has a generally elliptical center hole 23. By inserting the main body or gripper member of the suspender grasping assembly 10, which preferably has an outer periphery of generally elliptical contour, the suspender grasping assembly 10 is prevented from rotating relative to the pawled washer 19; and relative rotation of the illumination instrument support member 21 relative to the pawled washer 19 is also prevented by the pawls provided at four corners of the washer 19.

Figure 3B:
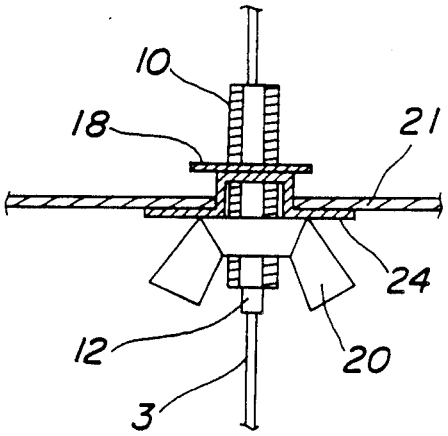
Figure 4B:
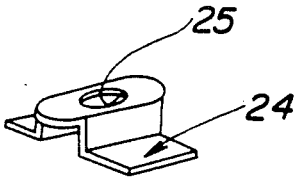
FIG. 4*b* is a perspective view showing a stepped washer used in the embodiment of FIG. 3*b*.
Figure 5:
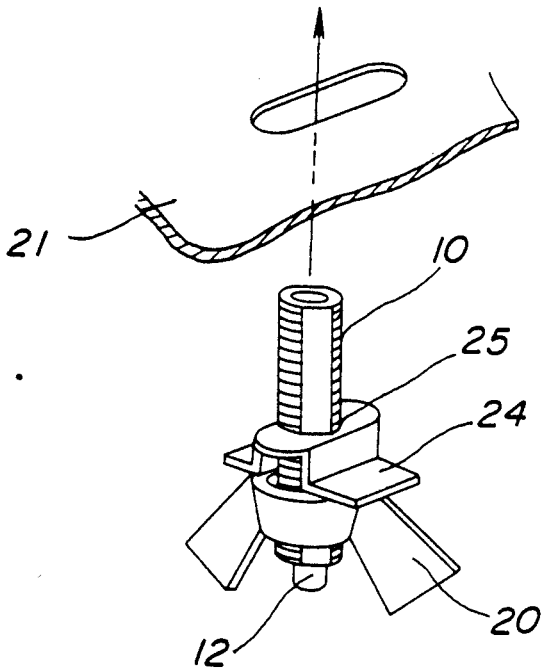
FIG. 5 is an illustration showing the operation of assembling the suspender grasping assembly of the embodiment shown in FIG. 3*b*, in which the stepped washer is used, to the illumination instrument support member.

Another embodiment of the rotation preventing means is shown in FIGS. 4*b* and 5. In this alternative embodiment, a stepped washer 24 as shown in FIG. 4*b* is used. The stepped washer 24 has a footbridge-like contour and a generally elliptical opening 25 is formed through a raised bracket portion of the stepped washer 24. On the other hand, diametrically opposed circumferential portions of the outer periphery of the main body of the grasping assembly 10 is cut away to form parallel planar portions. The thus shaped slider 12 is inserted through the elliptical opening 25 to prevent relative rotation. Then, similarly to the embodiment using the pawled washer 19, the suspender grasping assembly 10 is fastened by threading the butterfly nut tightly (see FIG. 3*b*).

The operation sequence for securing one or more illumination instruments, according to this invention, will now be described.

Figure 6:
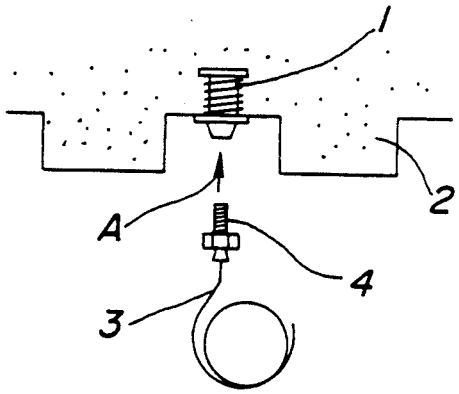
FIGS. 6 to 10 are schematic illustrations showing the operation sequence for securing the illumination instrument support member according to this invention.
Figure 7:
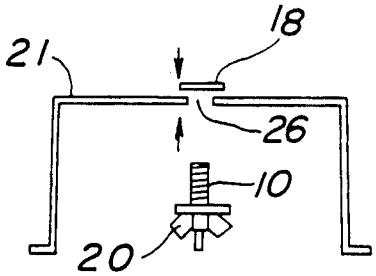

The anchor or insert 1 is preliminarily anchored into the slab 2, and one end (i.e. upper end) of the wire 3 having a desired length is inserted into the anchor grip 4. Then, the anchor grip 4 is threaded into the female thread of the anchor 1, as shown by the arrow A in FIG. 6, so that the anchor grip is fixed to the anchor 1 (First Securing Step). Alternatively, the anchor grip 4 may be first fixed to the anchor, followed by insertion of the upper end of the wire 3.

On the other hand, the main body or gripper member of the suspender grasping assembly 10, which has been screw-fitted with the butterfly nut 20, is inserted through the center hole 26 of the illumination instrument support member 21, and the suspender grasping assembly 10 is temporarily secured to the illumination instrument support member 21 by means of the rubber washer 18 frictionally engaging with the outer periphery of the suspender grisping assembly 10 (Second Securing Step) so that the illumination instrument support member 21 is not moved downwards during the subsequent operation. Meanwhile, this temporary securing (i.e. Second Securing Step) may be carried out in the factory for producing the securing practice of this invention.

Figure 8:
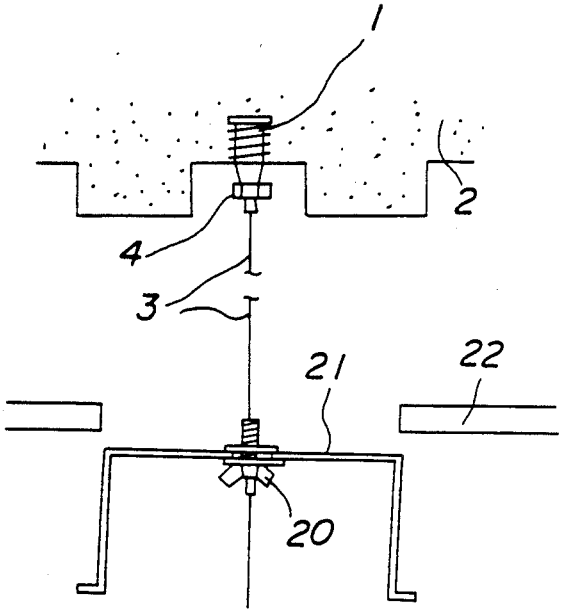

The next step is a step of inserting the lower end of the wire 3 suspended from the anchor grip 4 through the tapered bore 11 of the suspender grasping assembly 10 by which the illumination instrument support member 21 is grasped and held at a temporal set position, as shown in FIG. 8. The bottom plate of the illumination instrument support member 21 is now carried by the butterfly nut 20 through the pawled washer 19. The resulting assembly is then raised so that the member 21 comes near to the opening formed through the ceiling finish board 22.

Figure 9:
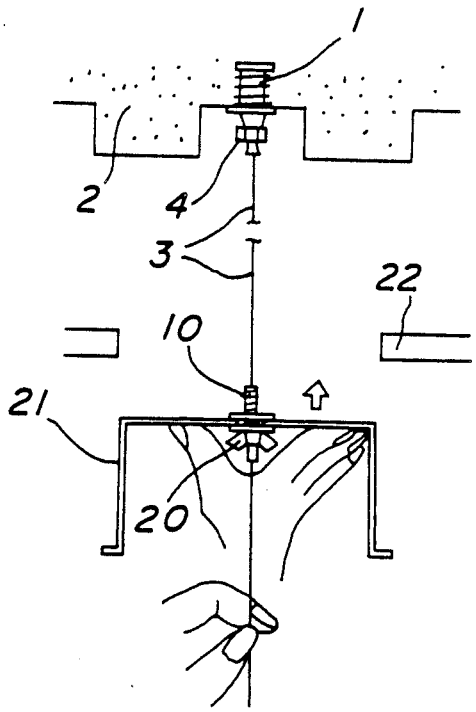
Figure 10:
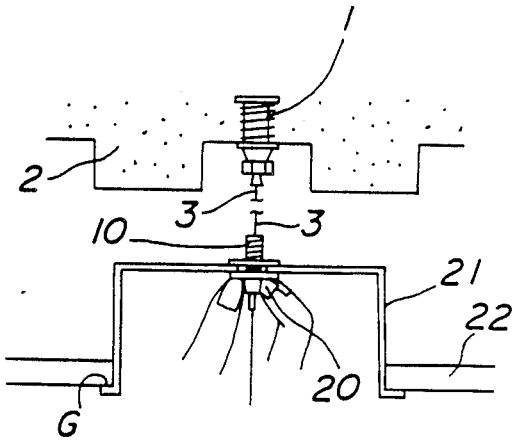

The illumination instrument support member 21, which has been raised to the position close to the opening of the ceiling finish board by the preceding step, is now raised upwards by one hand along the wire 3 while holding the lower end of the wire 3 by the other hand, as shown in FIG. 9, until the opening at the lowest position of the member 21 is substantially flush with (in other words, the whole body of the illumination instrument support member 21 is snugly contained in) the opening formed through the ceiling finish board 22. In case where it is desired to close the gap G (see FIG. 10) perfectly, the member 21 is raised or lowered within a certain limit by threading the butterfly nut 20 by the fingers of one hand. Thus, the illumination instrument support member 21 is secured fixdly at the appropriate height. The following operations includes, for example, incorporation of one or more illumination instruments within the space defined by the member 21, connection of electrical cables and assemblage of a reflector. However, since this operation is not included as essential features of this invention and are included within ordianry technical knowledge in the art, detailed description thereof will not be given herein.

As will be apparent from the foregoing, the end of the flexible suspender is inserted through a suspender grasping assembly so that the latter is allowed to slidingly move in the vertical direction and to be temporarily and finally set to any desired position along the suspender. The suspender grasping assembly also carries an illumination instrument support member. With this construction, even when the opening provided through the ceiling finish board for receiving an illumination instrument support member is not exactly coplanar with the bottom opening of the support member, these two openings can be in registry with one another by bending or otherwise deforming the flexible suspender.

By the provision of the suspender grasping assembly, coarse height adjustment can be done by any desired stroke followed by fine adjustment by the use of the butterfly nut or like fastening means. According to a still further aspect of this invention, a rubber washer or like engaging means is provided to effect temporary securing of the suspender grasping assembly so that the subsequent operation can be done easily and rapidly. In addition, rotation preventing means is provided to prevent the suspender grasping assembly from rotating relative to the suspender during the fastening operation for fixedly securing the system at the final set position. Finally, the system of this invention may be used without the need of special jigs or tools, and yet the operation required for suspending the illumination instrument can be carried out in a simple manner with low cost.

Although the invention has been described with reference to presently preferred embodiments, many modifications and variations may be made in the light of the disclosure given above and the appended claims. It is intended to include all such modifications and variations within the scope of the invention which is limited only by the definition recited in the claims.

What is claimed is:

1. A system for fixedly securing an illumination instrument to a ceiling of a building structure, comprising a flexible suspender adapted to be connected to an under surface of a slab of said building structure and extending generally vertically therefrom, a suspender grasping assembly for releasably grasping said flexible suspender to move therealong in a vertical direction and to be held at any desired height, and engaging means frictionally engaging with an outer periphery of said suspender grasping assembly to hold an illumination instrument support member at a temporal set position, said suspender grasping assembly including an upwardly-converging tapered bore within which a slider having a hollow extension extending in a longitudinal direction of the slider is contained to move along a vertical direction and normally biased upwards by a compression spring disposed within the bore, and plural clamping members disposed on an upper end of the slider movable in a radial direction along the tapered bore by a pushing force of the spring.

2. The system of claim 1, further comprising fixation means having its base anchored into said slab, and an anchor grip connected to said fixation means and grasping an upper end of said flexible suspender.

3. The system of claim 2, wherein said anchor grip allows insertion of one end of said flexible suspender in a direction toward said slab and prevents pull-out of said one end of said flexible suspender in a direction toward said illumination instrument support member, and wherein said suspender grasping assembly allows insertion of the other end of said flexible suspender in a downward direction and prevents pull-out of said other end of said flexible suspender in an upward direction.

4. The system of claim 1, further comprising rotation preventing means for preventing rotation of said illumination instrument support member.

5. The system of claim 4, wherein said rotation preventing means comprises a washer having pawls for preventing rotation of said illumination instrument support member.

6. The system of claim 4, wherein said rotation preventing means comprises a stepped washer having a raised bracket portion which snugly fits into an opening of said illumination instrument support member for preventing rotation of said member.

7. The system of claim 4, 5 or 6, wherein said rotation preventing means further comprises a hole which snugly fits on said outer periphery of said suspender grasping assembly to prevent rotation of the grasping assembly.

8. The system of claim 4, 5 or 6, wherein said rotation preventing means is secured by means of a nut.

* * * * *